US006092626A

United States Patent [19]

Young

[11] Patent Number: 6,092,626

[45] Date of Patent: Jul. 25, 2000

[54] TURNTABLE WORK SUPPORT

[76] Inventor: Roland O. Young, 5950 E. Lake Dr., Grand Forks, N. Dak. 58201

[21] Appl. No.: 09/228,584

[22] Filed: Jan. 11, 1999

[51] Int. Cl.[7] ..... E06C 7/00

[52] U.S. Cl. ..... 182/118; 182/149

[58] Field of Search ..... 182/118, 115, 182/117, 141, 65.1, 149; 14/69.5

[56] References Cited

U.S. PATENT DOCUMENTS 5,135,076 8/1992 Su ..... 182/48

*Primary Examiner*—Alvin Chin-Shue
*Attorney, Agent, or Firm*—Robert E. Kleve

[57] ABSTRACT

The invention comprises a turntable device for an apparatus having a pair of vertically adjustable work platforms with crosswalk between the platforms at the tops of the platforms, with a turntable device for each end of the crosswalk. The turntable device has a rectangular base with clamps for detachably mounting the base to the top of the platform, and a U shaped bracket pivotally mounted about a vertical axis on the base. A rod is mounted across the upper ends of the legs of the U bracket and the rod is adapted to be received in bores at each end of the cross walk for pivotally mounting the crosswalk at its ends to the platforms at their tops about a horizontal axis, whereby the platforms may be of different heights relative to one another with the crosswalk pivoting at its ends about a horizontal axes on the rods to accommodate the different heights and the platforms may be moved to different angles relative to one another on the ground with the U bracket pivoting their vertical axes to accommodate the different angles on the ground of the platforms.

2 Claims, 3 Drawing Sheets

TURNTABLE WORK SUPPORT

This invention relates to walk support apparatus.

It is an object of the invention to provide an adjustable walk, support apparatus for mounting to the tops of a pair of telescoping work platforms for connecting the pair of work supports with a generally horizontal walk platform and which is adjustable in height individually by either support to adjust the walk over platform to a suitable angle where differences in the height of one of the supports is desired in connection with the other work support.

It is a further object of the invention to provide a novel adjustable turntable apparatus for a pair of vertically adjustable towers having a crosswalk between the tops of the towers for adjusting the connection between the crosswalk and the tops of the towers which can be adjusted about two axes.

It is another object of the invention to provide a novel turntable apparatus which provides a connection between two work supports which can be adjusted about two axes perpendicular to one another.

Further objects and advantages of the invention will become apparent as the description proceeds and when taken in conjunction with the accompanying drawings wherein:

BRIEF DESCRIPTION OF PREFERRED EMBODIMENT

Briefly stated the invention comprises a dual pair of turn table platforms or cross walk supports, said turntable supports having means to detachably mount their bottom to thetops of a pair of vertically adjustable work platform towers, said turntable cross walk supports being adapted to receive the ends of a cross walk beam for pivotally mounting the ends of the beam about vertical and horizontal axis so that the cross walk may be connected between the turntable platforms on the towers and one of the towers may be raised or lowered to a different height relative to the other tower and the cross walk may be pivoted about its horizontal axis to accommodate the raising or lowering movement of the towers.

Figure 1:
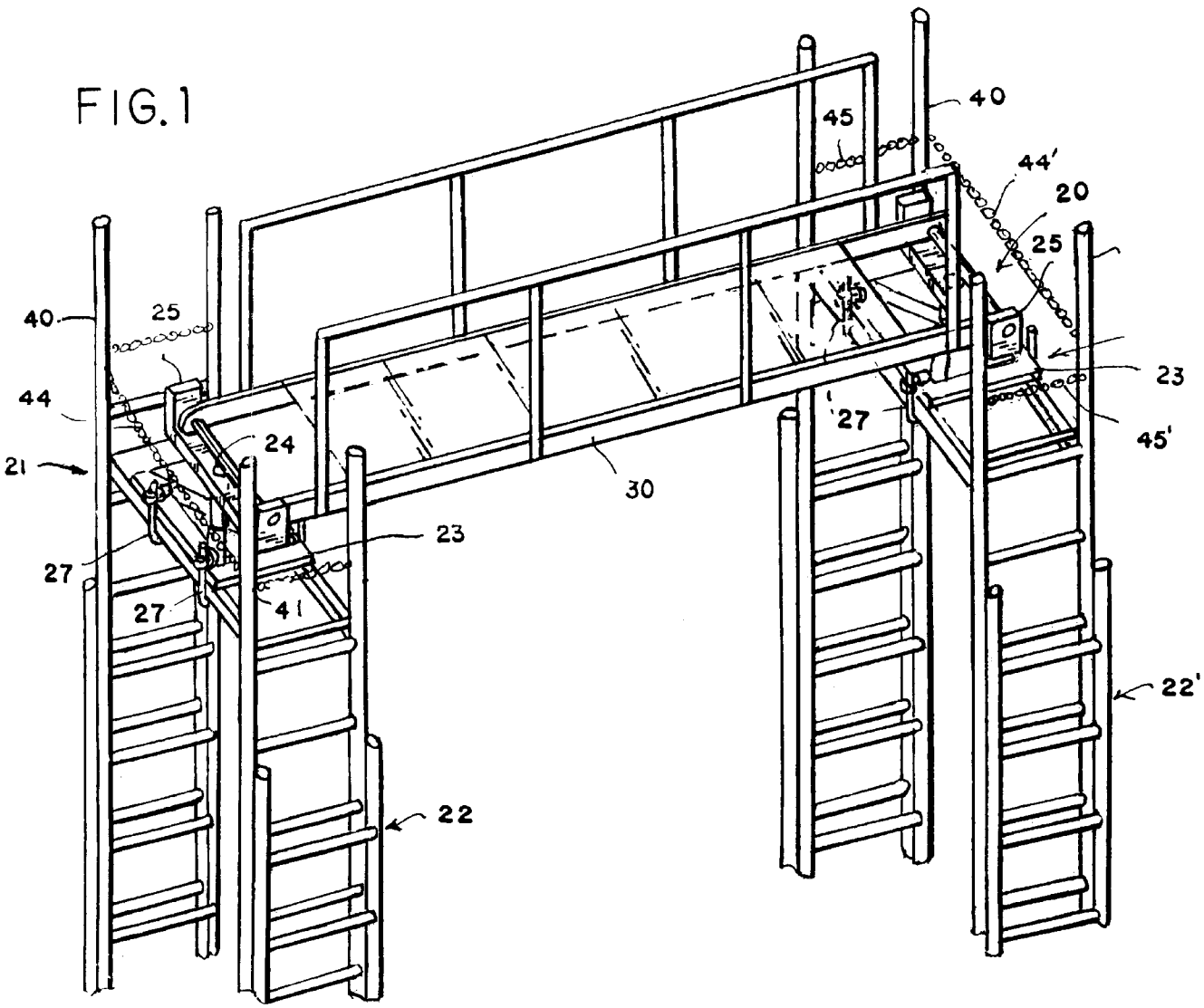
FIG. 1 is a perspective view of the dual pair of cross walk support apparatus having a pair of adjustable supports mounted to the top of an adjustable pair of supports with a mounting bar on each support which is adapted to pivotally receive one end of a cross walk to pivot the support about a horizontal axis with each support also being pivotal about a vertical axis to provide a walk way between the support which can be adjusted by the adjustable towers upward with one at an angle to one another and which can be adjusted horizontally to different positions along a horizontal plane.

Referring more particularly to the drawings, in FIG. 1, the dual pair of turntable cross walk support apparatus 20 is illustrated having adjustable turntable cross walk bar supports 21' and 21" mounted to the top of a pair of vertically adjustable platform towers 22 and 22' for connection between the towers and a cross walk 30.

Each turntable work support or trunnion 21' and 21" has a rectangular base 23 with a center column 24 and a center sleeve 24' which is rotatably mounted on the center column with a U shaped turntable frame 25 fixed to the top of the sleeve and a cylindrical rod 26 rotatably mounted to the U shaped turntable frame 25.

Figure 4:
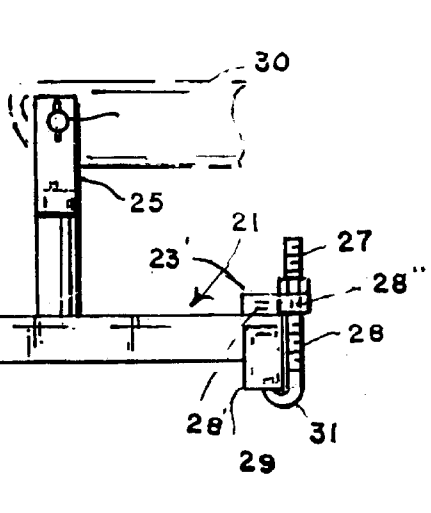
FIG. 4 is an end view of one of the cross walk supports.

The rectangular base 23 has four J shaped clamps 27 which are slidably mounted at their base leg 27' in a bore 28' of a sleeve 28. The sleeve 28 has a pin 28" fixed to it which pin is pivotally mounted about a horizontal axis in a sleeve 23' which sleeve 23' is fixed to the base 23, so that the each clamp 27 can pivot about a horizontal axis to a storage position encircling the pin 23" fixed to the base 23 as shown in FIG. 3, with the nut 32 threaded onto the base leg 27' of the clamp can be threaded to lengthen the J shaped end of the clamp sufficiently to enable the J shaped end of the clamp to encircle the pin 23" and then the nut threaded in the other direction to tighten the J shaped end of the clamp on the pin by movement of the clamp away from the pin. The base 23 of each work support 21' and 21" can be mounted to the top panel 29 of each of the conventional work towers by loosening the clamps from the pins 23" and pivoting the clamps downward about pins 28" from their position shown in FIG. 3 to their position shown in FIGS. 1, 2 and 4 and threading the nuts 32 along the legs 27' on the clamps to lower the J shaped ends of the clamps downward on their pivot sleeve 28 enable them to encircle the edges 31 and 31' of the tower top panel 30 of each of the towers, and then tightening the bolts on the clamps to tighten the J shaped clamps to the top panel of the support towers to tighten the rectangular base of the work support turntable members 21 and 21' to the support towers 22 and 22', respectively.

The legs 33 and 33' of the U shaped turntable brackets 25 of the apparatus have bores 34 there through to enable the rod 26 to be slid through the bores, with a disc 35 fixed to one end of the rods to keep one end of the rod on the U bracket and a cotter key 35' extending through a bore in the opposite end of the rod to hold the other end of the rod on the U shaped bracket in the bores. The crosswalk 30 has a pair of bores 37 at each end for receiving the rod 26 of each turntable for mounting the crosswalk at its ends to the turntables 21 and 21.

OPERATION

The turntables 21 and 21' enable the one of the pair of conventional height adjustable towers to be raised or lowered relative to the other tower by the cross walk 30 pivoting in the bores 37 at the ends of the cross walk on the support rods 26 about a horizontal axes of the rods 26 with one end of the crosswalk pivoting vertically in one direction on the rod while the other end of the cross walk also pivots vertically in the opposite direction in the bores at the other end of the cross walk on the support rod 26 of the other turntable support. Also, the adjustable towers may be rolled on rollers at the bottom of the towers to different locations on the ground with one tower at an angle relative to one another with the turntable U shaped frames pivoting about their vertical axes to accommodate the change in the angle of the one tower relative to the other in the movement of the towers.

The vertically adjustable towers 22 and 22' each have a pair of relatively high posts 40 and 41 at their outer corners in relation to their inner corner posts 42 and 43. A pair of chains 44 and 44' are connected across each pair of high posts to provide an outer guard for persons on the towers and going from the towers to the cross walk. Also a pair of chains

Figure 2:
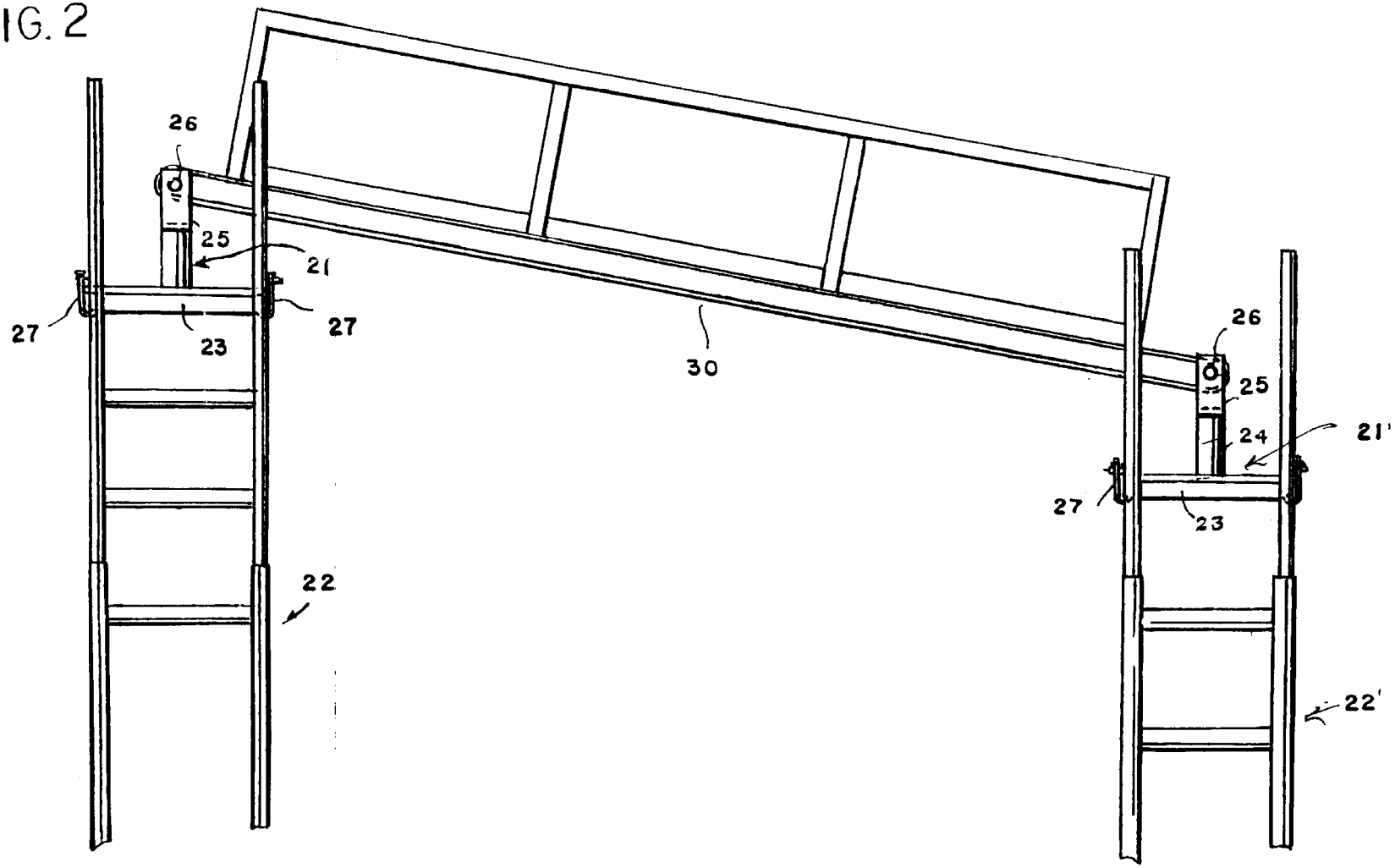
FIG. 2 is a side elevational view of the dual pair of cross walk support apparatus shown mounted to a pair of vertically adjustable work, platform towers.
Figure 3:
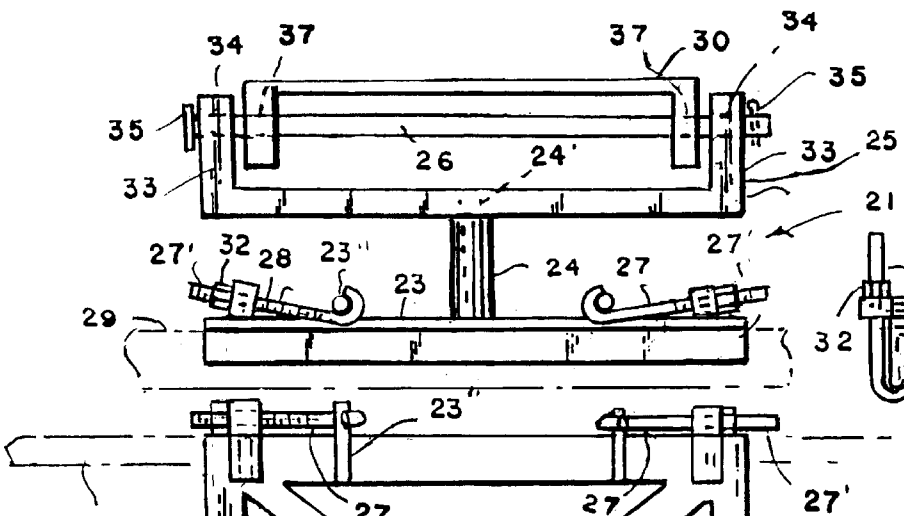
FIG. 3 is a side elevational view of one of the cross walk supports.
Figure 5:
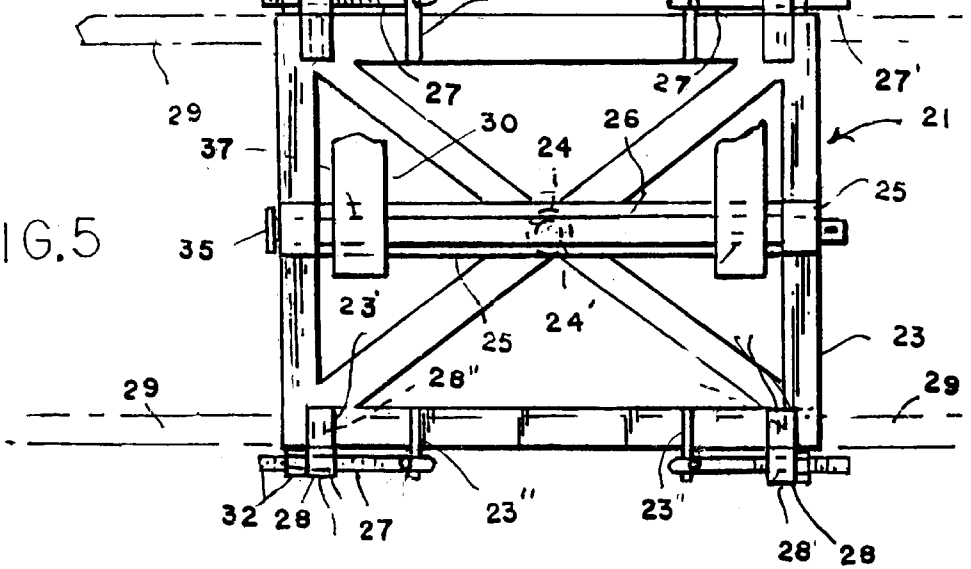
FIG. 5 is a top plan view of one of the cross walk supports.

45 and 45' are connected across the the outer corner posts to the inner corner posts to provide a side guard for persons on the walk or the top of the towers, as shown in FIGS. 1 and 2.

Thus, it will be seen that a novel turntable crosswalk apparatus has been provided which provides a crosswalk between adjustable towers and which are pivotal in their connection between the crosswalk and the towers about a vertical and horizontal axis to enable the towers to adjust to different heights to one another with the crosswalk also adjusting to the different heights and remain connected to the towers and which can be adjusted about vertical axis to enable one tower to be positioned as a angle relative to the other tower on the ground by movement of one tower relative to the other on their supporting wheels.

It will be obvious that various changes and departures may be made to the invention without departing from the spirit and scope thereof, and accordingly. it is not intended that the invention be limited to that specifically described in the specification or as illustrated in the drawings, but only as set forth in the appended claims wherein:

What is claimed is:

1. An height adjustable crosswalk apparatus comprising a pair of vertically upright telescoping platform towers spaced horizontally from one another, an horizontally elongated crosswalk having opposing ends with horizontal rods mounted in their opposed ends, said horizontally elongated cross walk extending generally horizontal in length with one end adjacent the top of one of the towers and the other end adjacent the top of the other of the towers, the towers each having a horizontal platform mounted to their tops, pair of turntables each having a horizontal base panel with a vertical yoke rotatably mounted to the base panel and extending upward therefrom to rotate about a vertical axis, said base panels of said turntables having a size approximating the size of the top platforms of the towers to overly the tower platforms with means at the outer edges of the turntable base panels securing the turntable base panels to the outer edges of the top platforms of the towers, means on the towers to individually raise and lower the towers whereby the cross walk may pivot upward at one end at angle from horizontal in relation to its other end, when the tower at the one end of the crosswalk is telescoped vertically above the tower at the other end of the crosswalk by the crosswalk pivoting on the horizontal rods which is connected to the yokes of the turntables, and whereby the towers may be moved horizontally from one another to move the crosswalk at an angle horizontally from its previous position with the yokes of turntables pivoting about their spaced vertical axes to their mountings to the turntable base panels.

2. A turntable device according to claim 1, wherein said means securing said turntable base panels to said top platform comprises J shaped clamps with their leg portions pivotally mounted to said turntable base panels and adjustable along its leg to different distances relative to said turntable base panels with said J shaped clamps being adapted to encircle bottom portions of said top platforms to provide a fixed connection from said turntable base panels to the top platforms.

* * * * *